US006068225A

United States Patent [19]

O'Brien et al.

[11] Patent Number: 6,068,225

[45] Date of Patent: May 30, 2000

[54] MULTI-LEVEL TRAPEZE HANDLE AND SUPPORT SYSTEM FOR ELDERLY AND DISABLED PERSONS

[76] Inventors: John Leonard O'Brien, 11 Parklane Crt., Gloucester, Canada, K1B 3H3; Edward M. Thomas, 522 Gascon St., P.O. Box 131, Russell, Canada, K4R 1E3; Donald A. N. Ed, 27 Pentry La., Ottawa, Canada, K1S 0X1

[21] Appl. No.: 09/154,049

[22] Filed: Sep. 16, 1998

Related U.S. Application Data

[60] Provisional application No. 60/059,517, Sep. 19, 1997.

[51] Int. Cl.[7] ..... A47C 31/00

[52] U.S. Cl. ..... 248/200.1; 5/662; 5/81.1 R

[58] Field of Search ..... 248/200.1, 161, 248/159, 121, 125.8; 5/81.1 R, 84.1, 87.1, 658, 662; 482/24, 49, 148

[56] References Cited

U.S. PATENT DOCUMENTS

| | | | |
|---|---|---|---|
| 632,114 | 8/1899 | Hendrickson | 482/49 |
| 1,376,247 | 4/1921 | Bishop | 4/577.1 |
| 1,840,170 | 1/1932 | Neils | 5/662 |
| 2,057,811 | 10/1936 | Armstrong | 5/662 |
| 2,490,130 | 12/1949 | Hollis | 5/85.1 |
| 4,101,036 | 7/1978 | Craig | 211/107 |
| 4,154,233 | 5/1979 | Brown | 606/241 |
| 4,253,207 | 3/1981 | Marcyan | 5/84.1 |
| 4,375,707 | 3/1983 | Boerigter | 5/81.1 R |
| 4,686,727 | 8/1987 | Wilkinson | 5/503.1 |
| 4,932,090 | 6/1990 | Johansson | 5/662 |
| 5,586,352 | 12/1996 | O'Brien et al. | 5/662 |
| 5,836,026 | 11/1998 | Reed | 5/662 |

*Primary Examiner*—Anita M. King

[57] ABSTRACT

A unique multi-level trapeze handle and support pole system for assisting elderly and disabled persons for sitting up in bed and standing up from bed. It comprises a telescopic pole adapted to be fixed between the floor and ceiling of a room, a horizontal arm fixed on the upper section of the pole, upon the end of which is suspended a unique "two tier" trapeze handle. The system is to be used by elderly or disabled persons to independently execute the following motions while in bed: pull themselves upward slightly to shift laterally in bed, pull themselves up to a seated position in bed, shift from seated position on the bed to standing beside the bed. This invention relates to our U.S. Pat. No. 5,586,352 which describes a support pole with pivoting and locking handrail for elderly and disabled persons.

8 Claims, 2 Drawing Sheets

Side Views

MULTI-LEVEL TRAPEZE HANDLE AND SUPPORT SYSTEM FOR ELDERLY AND DISABLED PERSONS

This application claims benefit to U.S. Provisional Application Ser. No. 60/059,517, filed Sep. 19, 1997.

BACKGROUND OF THE INVENTION

This invention relates to a multi-level trapeze handle and support system for assisting disabled or elderly persons to shift, sit up and transfer out of their bed independent of any assistance.

Bed mobility for elderly and disabled persons requires assistance in several ways; to shift sideways to a more comfortable position or remove weight from a sore section of the body, to pull oneself up from a lying down position to a seated position in bed, to pivot around to seated position on the side of the bed, and rise to a standing position beside the bed.

In order to execute this entire sequence of motions, the person must have access to gripping surfaces on which to pull, push or simply bear weight for balancing purposes. One of the most popular devices to assist with this function is the over-the-bed trapeze handle.

Conventional trapeze handles, named after the "trapezoid" shape, are more commonly shaped like an equal sided triangle. This triangle handle shape has been used for well over 100 years over hospital and home beds to help individuals pull themselves up to a sitting position as well as to shift position in bed. The triangle shape unfortunately only provides one horizontal rail on which to grasp to pull oneself up to a sitting position. This reduces ones capabilities in two ways . . . Firstly, the standard trapeze handle places high demands on elbow/arm range of motion—in order to pull oneself up to a fully sitting up position from lying down, ones arms are forced to pull to such a point that the elbows are awkwardly fully bent before one is fully sitting up. Secondly, the standard trapeze handle makes poor use of available arm strength—The more ones elbows become bent, the less force one can generate.

Our invention, the mulit-level trapeze handle, was design to provide the best possible assistance to those needing help to sit up and move in bed. The difference is in the second horizontal rail offered; it provides a second higher level allowing one to effectively "climb up" to a seated position. The second higher rail also reduces the range of motion required of the elbow and shoulder. Additionally, by pulling from the higher rail one can produce significantly more force to pull oneself up to sitting.

Also of note is that trapeze handles must be suspended from an overhead structure. Traditionally, these structures have required special beds, or bulky floor mounted structures. In addition, once the user has used a trapeze to rise to a seated position in bed, the trapeze is no longer effective in providing support to help the user stand up from the bed.

Clearly no single ideal support device exists in the prior art to cover the optimal requirements for overhead support to facilitate sitting up in bed, through to support beside the bed for standing assistance.

BRIEF SUMMARY OF THE INVENTION

This invention relates to a multi-level trapeze handle and support system for assisting disabled or elderly persons to shift, sit up and transfer out of their bed independent of any assistance.

The system is to be used by elderly or disabled persons to independently execute the following motions: pull themselves slightly upward to shift laterally in bed, pull themselves up to a seated position in bed, pivot one's legs off the edge of the bed, and stand up from seated position on the edge of the bed.

The device comprises a pole adapted to be vertically fixed between the floor and ceiling of a room and a horizontal arm fixed to the upper section of the pole, upon the end of which is suspended a unique multi-level trapeze handle.

The horizontal arm consists of a horizontal tubular member fixed to a cylindrical member which is removably fixed onto the upper section of the pole.

The trapeze handle consists of a bent tubular form that presents two horizontal rails for the users gripping which are separated vertically and fore and aft from each other.

The trapeze handle is suspended from the support arm by use of fabric type webbing with a means for webbing functional length adjustment.

Advantageously, the support arm may be adjusted in height along the pole, and the webbing may be adjusted in length to change the functional height of the trapeze handle to the user.

Further, the open design of the trapeze handle permits it being hooked around the pole for storing it out of the way.

DETAILED DESCRIPTION OF THE PREFERRED EMBODIMENT

Figure 1:
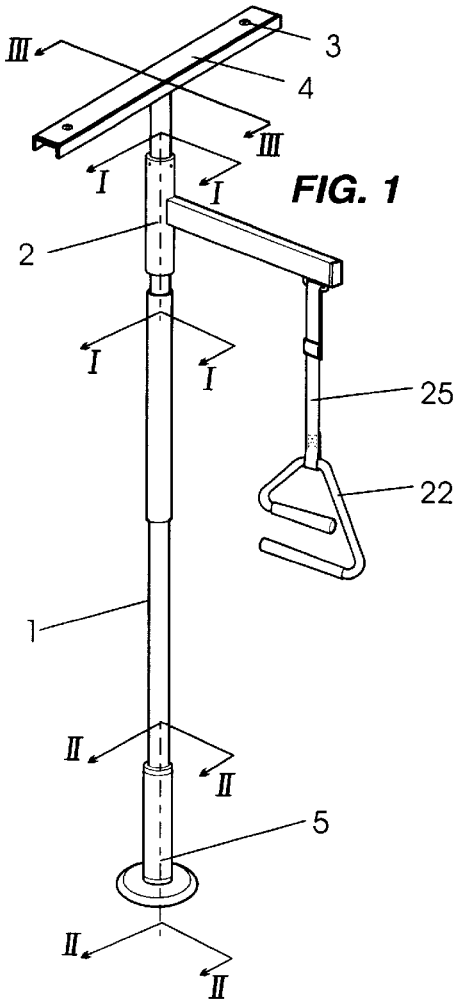
FIG. 1 is an isometric view of one embodiment of the invention

FIG. 1 shows the general appearance of the invention. Support pole 1 is anchored to the ceiling by the upper support beam 4 which has apertures 3 for fastening to ceiling members where appropriate.

Base 5 has a screw jack arrangement to compress pole 1 between the floor and ceiling of a room.

Figure 3:
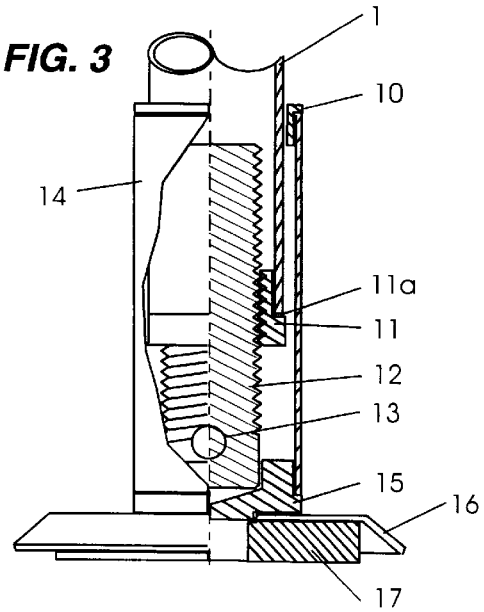
FIG. 3 is a cutaway view of the base (section II—II)

FIG. 3 details the arrangement of the base 5. Bottom end of pole 1 rests on shoulder 11*a* of the female threaded member 11. Male thread member 12 rests within bottom bushing 15 which rests upon base plate 16 which has a resilient underpad 17. Hole 13 allows the jack screw turning tool (not shown) to be inserted therein to rotate male threaded member 12 to extend pole 1 and compress it between the floor and ceiling of a room.

Cover member 14 can be moved up on pole 1 with its mounting bushing 10 to permit access to member 12 and in the closed position the bottom of cover member 14 engages bushing 15.

Figure 4:
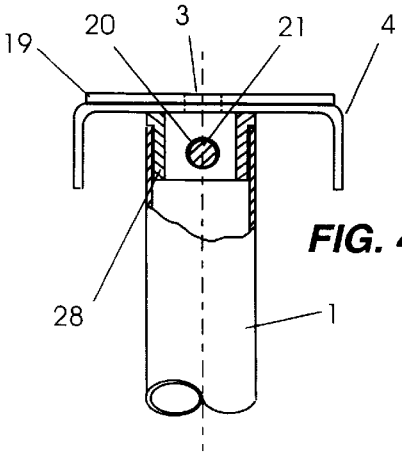
FIG. 4 is a cutaway view of the upper support beam (section III—III)

FIG. 4 provides the construction of the upper support beam 4. Pole 1 fits over bushing 28 and pin 21 fits through hole 20 in pole 1 and hole in bushing 28. Bushing 28 is welded to the upper support beam member which has a resilient pad 19 on it and apertures 3 in it to permit passage of fasteners into ceiling members. Upper support beam 4 has a slight curvature whereby the ends engage the ceiling first.

Figure 2:
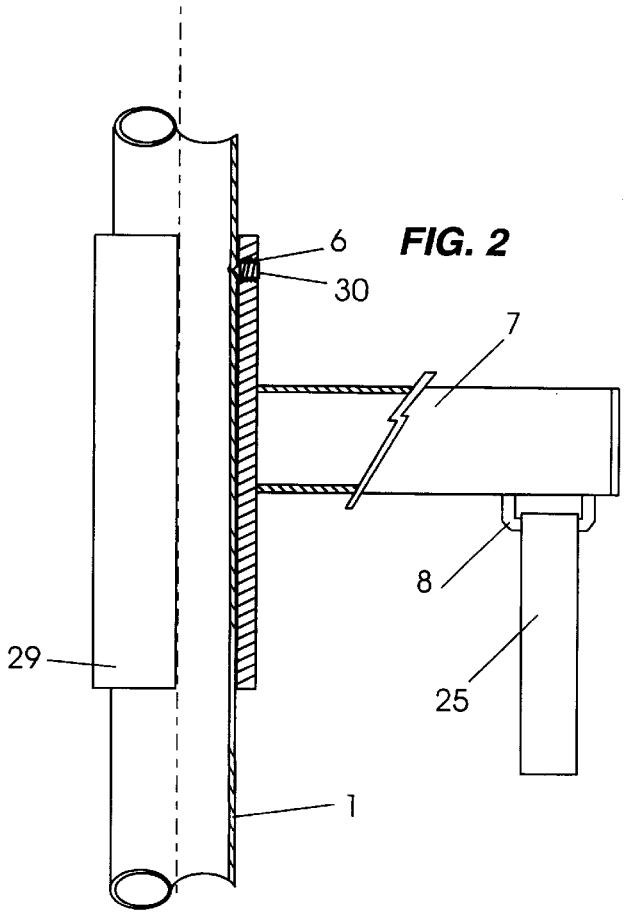
FIG. 2 is a cutaway view of the support arm (section I—I)

FIG. 2 illustrates the support arm 2. Cylindrical member 29 has tubular member 7 protruding radially outward. Tubular member 7 has u-shaped hook attached to support fabric webbing 25 which in turn supports the trapeze handle. Cylindrical member 29 has threaded holes 6 which accept cone pointed Allen screws 30 to secure support arm 2 to pole 1. The support arm 2 is fixedly yet removably mounted on pole 1 in a manner which allows the user to select the most advantageous height and angular orientation.

Figure 5:
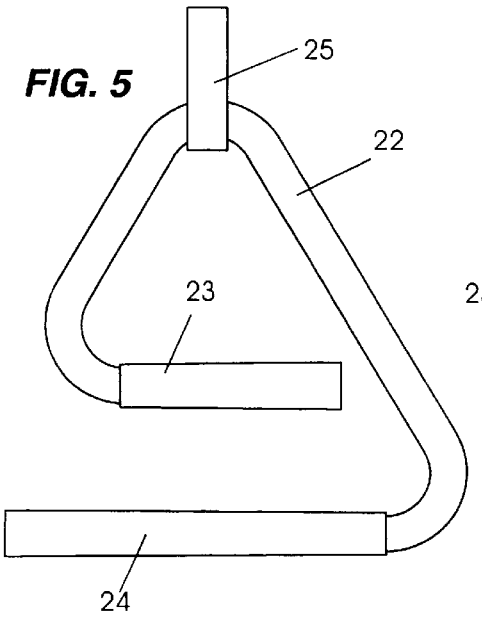
FIG. 5 is a front view of the preferred embodiment of the multi-level trapeze handle
Figure 6:
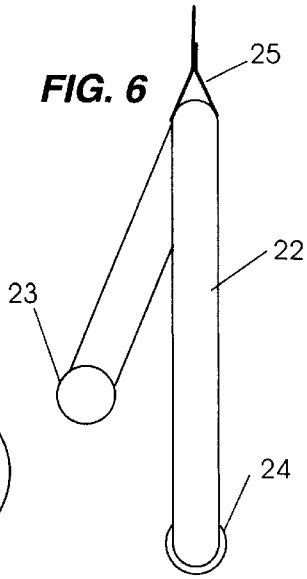
FIG. 6 is a side view of the preferred embodiment of the multi-level trapeze handle

FIGS. 5 and 6 details the preferred embodiment of trapeze handle 22, formed from a tubular member to provide two vertically separated horizontal rail sections with resilient grip material thereon 23 and 24. The trapeze shape includes an apex at the top to nest the support webbing 25.

Figure 7:
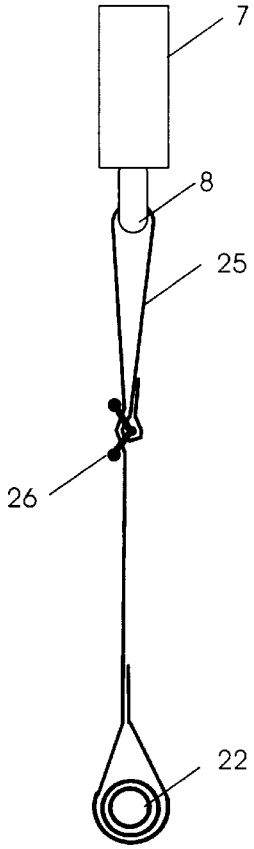
FIG. 7 is a view of the webbing which supports the trapeze from the support arm
Figure 8A:
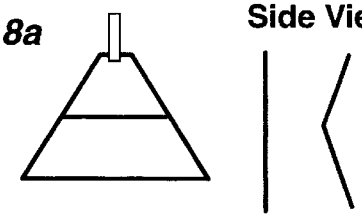
FIGS. 8*a* through 8*d* illustrate other embodiments of the multi-level trapeze
Figure 8B:
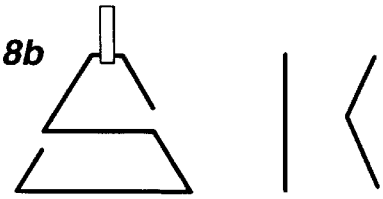
Figure 8C:
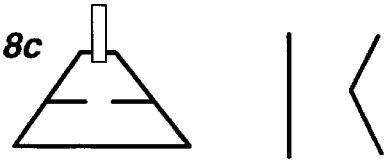
Figure 8D:
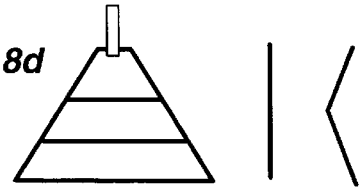

FIG. 7 shows a side view of the preferred embodiment of the webbing assembly to support the trapeze handle. Fabric webbing 25 drapes over u-shaped hook 8 at the end of support arm 7. Slide lock 26 permits adjustment of functional length of webbing assembly between u-hook 8 and trapeze handle 22.

FIGS. 8*a* through 8*d* show alternate embodiments of the multiple tier grip handle along with side views indicating straight and bent profiles.

We claim:

1. A trapezoidal support device for elderly and handicapped persons, said device comprises a pair of unequal length side members wherein the side members are angularily joined to create an apex: the device is adapted to be suspended at the apex and the side members terminate to form a pair of parallel spaced horizontal grip members.

2. A trapezoidal support device as claimed in claim 1 wherein the grip members are vertically displaced with respect to one another.

3. A trapezoidal support device as claimed in claim 1 wherein the grip members are laterally displaced with respect to one another.

4. A trapezoidal support device as claimed in claim 2 wherein the grip members are laterally displaced with respect to one another.

5. A support system for elderly and disabled person, comprising a support pole which is adapted to be anchored between the floor and ceiling and having a horizontal support arm movably and lockingly mounted therein, the end of the arm retains a flexible tension member which anchors a trapezoidal support device; the device consists of a pair of unequal length side members, the side members are angularity joined to create an apex, the apex is retained by the tension member and the side members terminate to form a pair of parallel spaced horizontal grip members.

6. A support system as claimed in claim 5 wherein the grip members are vertically displaced with respect to one another.

7. A support system as claimed in claim 5 wherein the grip members are laterally displaced with respect to one another.

8. A support device as claimed in claim 6 wherein the grip members are laterally displaced with respect to one another.

* * * * *